US007600796B2

(12) United States Patent
Liang et al.

(10) Patent No.: US 7,600,796 B2
(45) Date of Patent: Oct. 13, 2009

(54) NIGHT LATCH

(75) Inventors: Luke Liang, South Plainfield, NJ (US); Tong Liang, Guangzhou (CN); Chen Chen, N. Guangzhou (CN)

(73) Assignee: Vision Industries Group, So. Plainsfield, NJ (US)

( * ) Notice: Subject to any disclaimer, the term of this patent is extended or adjusted under 35 U.S.C. 154(b) by 34 days.

(21) Appl. No.: 11/388,786

(22) Filed: Mar. 24, 2006

(65) Prior Publication Data

US 2007/0222233 A1 Sep. 27, 2007

(51) Int. Cl.
*E05C 17/44* (2006.01)

(52) U.S. Cl. ..... 292/338; 292/DIG. 37; 292/DIG. 47; 292/DIG. 20; 292/207

(58) Field of Classification Search ..... 292/338, 292/DIG. 37, DIG. 47, DIG. 20, 207, 109, 292/121, 108, 60, 63, 67, DIG. 31, DIG. 63, 292/219, 224, 183, 184
See application file for complete search history.

(56) References Cited

U.S. PATENT DOCUMENTS

| | | | | | |
|---|---|---|---|---|---|
| 2,077,629 | A * | 4/1937 | Lahr | 248/294.1 |
| 4,365,831 | A * | 12/1982 | Bourne | 292/229 |
| 4,647,088 | A * | 3/1987 | Nelson | 292/136 |
| 5,018,241 | A * | 5/1991 | Baines | 16/82 |
| 5,172,520 | A * | 12/1992 | Hostetler et al. | 49/449 |
| 5,452,596 | A * | 9/1995 | Yamada | 70/208 |
| 5,457,971 | A * | 10/1995 | Yamada | 70/208 |
| 5,556,145 | A * | 9/1996 | Takasaki | 292/336.3 |
| 6,364,375 | B1 * | 4/2002 | Szapucki et al. | 292/63 |
| 6,572,158 | B2 * | 6/2003 | Szapucki et al. | 292/221 |
| 6,606,889 | B1 * | 8/2003 | Tweedy | 70/208 |
| 6,848,728 | B2 * | 2/2005 | Rotondi et al. | 292/336 |
| 6,969,824 | B2 * | 11/2005 | Silvestro | 219/133 |
| 2005/0011131 | A1 * | 1/2005 | Liang et al. | 49/449 |

* cited by examiner

*Primary Examiner*—Patricia Engle
*Assistant Examiner*—Mark Williams
(74) *Attorney, Agent, or Firm*—Thomas A. O'Rourke; Bodner & O'Rourke LLP

(57) ABSTRACT

The present invention relates to a night latch in particular a night latch that includes a housing, tumbler, button, and a two resilient members. The housing of the present invention maintains the tumbler, button, and two resilient members. The housing also may have at least one protrusion located on its sidewall. The tumbler of the present invention has a pivoting member along with a means for housing a resilient member. In addition the tumbler of the present invention may have recess located on its front face. The tumbler also has at least one groove that co-acts with the protrusion on the sidewall. A first resilient member is used force the tumbler into an exposed position, and a second resilient member is used to keep the tumbler in a retracted position, via the co-action of the recess in the tumbler and a protrusion on the bottom portion of the button.

16 Claims, 10 Drawing Sheets

NIGHT LATCH

FIELD OF THE INVENTION

The present invention is directed to the field of window hardware, particularly window hardware for double hung windows.

BACKGROUND OF THE INVENTION

Double hung windows are a common type of window used in many homes and remodelings. There is a frame with a pair of tracks on each side of the frame. There is a top sash and a bottom sash. The top sash typically rides in the outer tracks, i.e. the tracks in the frame closest to the outside of a building. The lower sash rides in the inner track, i.e. that track that is closest to the interior of a house. The sash has a pair of vertical stiles that are joined to upper and lower horizontal styles. One or more panes of glass are retained in the sash. There can be an inner pane and an outer pane that extends from one vertical stile to the other and from one horizontal style to the other. There can be a third pane of glass positioned similarly with a gap between the first and second panes. The gap is usually filled with an inert gas such as argon. This structure provides a window with insulating qualities. One or more muntin bars can be present to provide a look of individual lights in the window of the type that are found in older construction.

In many double hung windows there is an issue of security. There is usually an outer screen that permits cooler air to ventilate into the house during the warmer months. In order to take advantage of the screen however, the bottom pane typically must be in a raised position. Double hung windows are usually provided with a sash lock that locks the lower and upper sash in position so that they cannot be opened from the outside. While this provides some security during the cooler months, the return of warm weather may make it difficult to use the sash lock in many instances. The sash lock has two positions, a locked position and an unlocked position. Thus the resident has a choice to either keep the window in a closed locked position or have the window sash unlocked and thus open to intruders.

In order to provide a means of ventilating a room yet provide some security, there have been a number of night latches and vent stops that have become available in the market. One such sash stop is U.S. Pat. No. 5,248,174 owned by Ashland Products. Another type of sash stop U.S. Pat. No. 4,923,230, owned by Ro Mai. These night latches or vent stops act in a similar fashion. The night latch or vent stop is placed in the face of the upper sash. Depending on the desired amount of ventilation, the night latch can be placed at any position on the face. Once the night latch is secured in the face of the window, the tumbler can be pressed in an inward and upward fashion activating a spring mechanism that will force the tumbler to an exposed position, thus creating the impeding force required to restrict movement of the lower window sash. Other prior art vent stops are U.S. Pat. Nos. 5,553,903 and 5,806,900 both of which are owned by Ashland.

As mentioned previously, the typical prior art vent stop prevented the opening of the lower sash in similar fashions. In the typical prior art the tumbler was held in a locked position via a catch portion located in the housing of the night latch. Thus, if inwardly and upwardly forces were applied perpendicularly to the face of the tumbler, these forces would free the tumbler from its locked, inactivated position, to its unlocked, activated position.

While the tumblers in the prior art night latches are capable of preventing the sliding member from moving passed a certain predetermined position, these tumblers have an unfavorable characteristic. That is in the prior art vent stop, in order for the user to free the tumbler from its inactivated position to its activated position or vice versa, the user must apply a multitude of forces in a variety of different angles.

Although the night latch and/or vent stops are capable of preventing the lower sash from moving passed a certain desired position, their utility is unfortunately outweighed by their inherent clumsy composition. The night latch in the present invention improves on the prior art shortcomings by implementing a unique method of activating and inactivating the tumbler from the housing, without taking away from its utility and its aesthetic quality.

OBJECTS OF THE INVENTION

It is an object of the present invention to provide a night latch that operates more easily than the prior art night latches.

It is an object of the present invention to provide an improved night latch that is more reliable in its operation than the prior night latches.

It is an object of the present invention to provide a night latch that allows the user to more readily reposition the tumbler back in an inactivated position.

It is still another object of the invention to allow the user the ability of activating the tumbler without the use of multiple forces to release the tumbler.

It is a still further object of the present invention to provide for a more durable night latch, so as to allow for a longer period of operability.

These and other objects of the present invention will become apparent to those skilled in the art from a review from the description provided below.

SUMMARY OF THE INVENTION

The present invention is an improved night latch or sash controlling mechanism. The improved night latch can be used with a variety of windows and doors, including but not limited to, single hung windows, double hung windows, sliding windows and doors, etc. The windows can be of the type that moves vertically or horizontally. If the windows are to move in a vertical fashion then the window will have upper and lower sashes situated in the frame of the window. If the windows are to move horizontally, then the windows will have right and left sashes situated in the window frame. A night latch for a sliding door can be installed and operated in the same manner as the sliding window, except the doors will sit in the door frame rather than a window frame. More specifically, this invention is directed to be an integral part of a sliding window or door, that is simple, inexpensive, and ergonomically superior to the prior art.

In the present invention the night latch has three primary components a tumbler, button, and a housing that will accommodate the tumbler and the button. The housing is placed in a groove or recess on the face of the upper window sash. The housing is constructed so as to make for a tight, smooth, and finished appearance when inserted into the groove of the window sash. This fit will make for an aesthetically pleasing appearance.

As in the prior art, a tumbler is generally used as the stopping mechanism in the night latch. In general, the tumblers are activated by applying an outside force in a multitude of ways directly to the tumbler, making for a rather difficult and sometimes impossible task. One example of this is when the spring inside the tumbler is new and rather tight. In the present invention the tumbler is activated via a separate button, located on the housing of the night latch. This allows the user to activate the tumbler with relative ease. The force applied can be in a downward motion, as in the present invention, or the force applied can be in an inward motion. The direction of the force applied depends on how the button is configured.

In addition to the relative ease of operation of the improved night latch. The improved night latch has an active cover located on the bottom of the housing, which allows for installing parts inside of the housing. In the prior art the housing is open, thus exposing the inside parts, such as the tumbler and spring, to the outside weathering elements, such as moisture in the air, which could cause malfunction of the night latch, i.e. rusty spring. In present invention the active cover acts as a barrier, so as to impede the destructive nature of weathering.

Furthermore, the night latch can be deactivated with even less effort than the prior art. If the user wished to close the night latch in the prior art, the user would have to exert an inward and downward force to deactivate the night latch. This is because the tumbler in the prior art is kept depressed via the face of the tumbler and the top plate of the housing. As mentioned previously application of these forces can prove to be rather burdensome when the night latch was fairly new. In the present improved night latch, the only force needed is a downward force, this is because of the coaction between the tensed bottom part of the button and the bottom protruding portion of the tumbler. The protruding portion of the tumbler serves a twofold function, first, it keeps the tumbler in a locked inactivated position, and second, when the button is depressed it keeps the tumbler in a locked activated position.

BRIEF DESCRIPTION OF THE DRAWINGS

FIG. 1(*a*) is a perspective view of the night latch of the present invention in place in a portion of a stopping member frame with tumbler exposed;

FIG. 2(*a*) is an exploded side view of the housing and tumbler of the present invention;

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
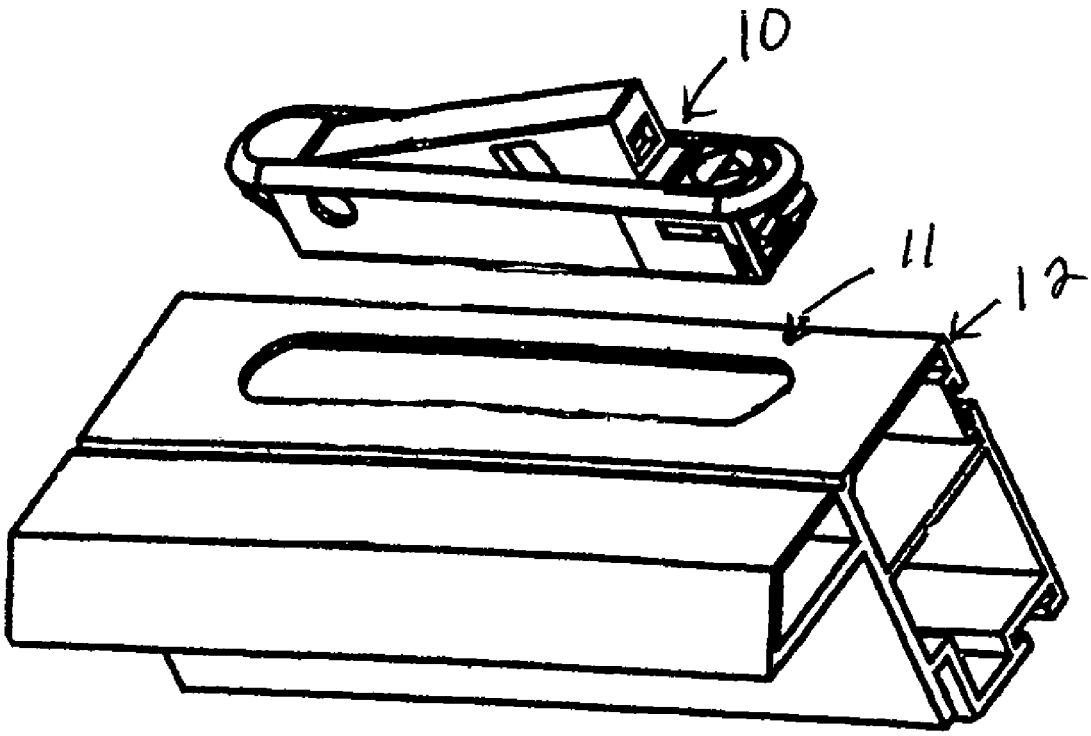
FIG. 1 is an exploded view of night latch and stopping member frame.
Figure 1:
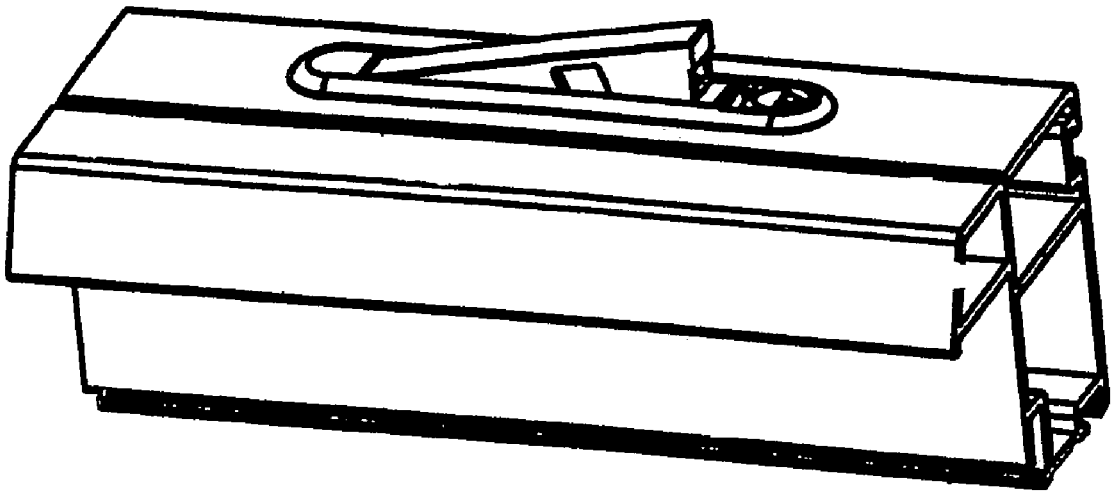
Figure 2:
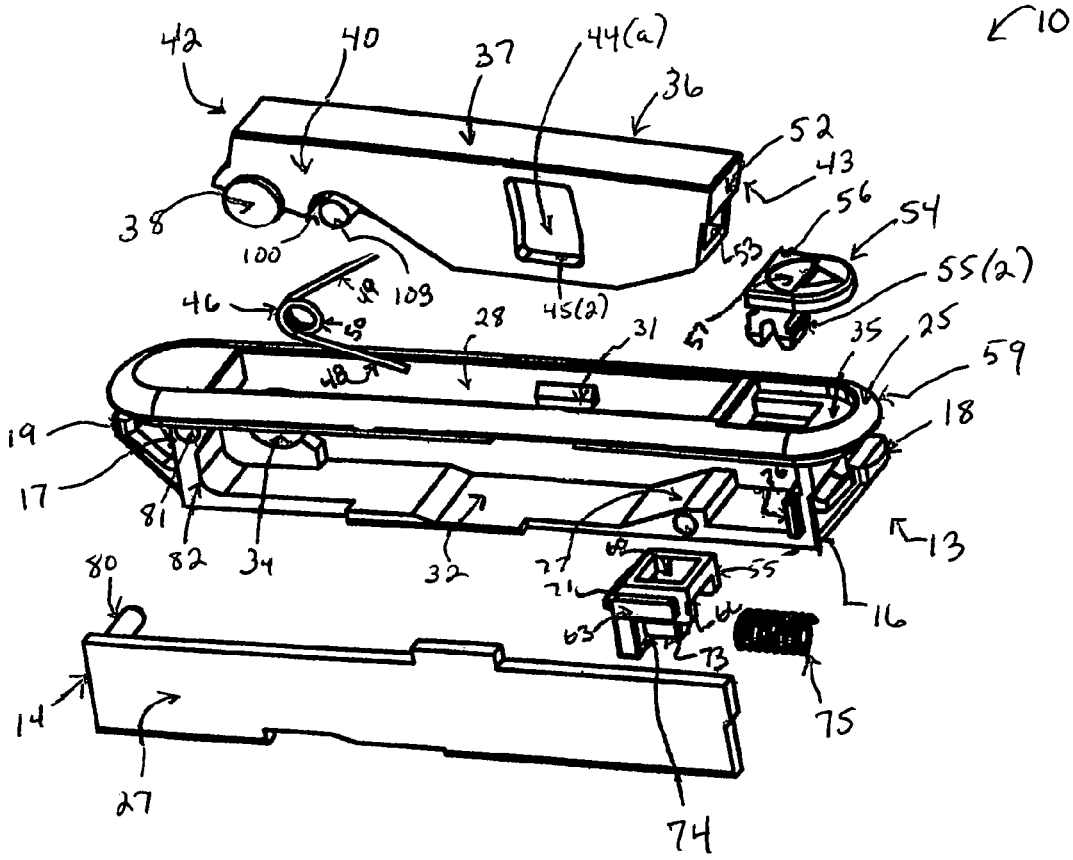
FIG. 2 is an exploded view of housing and tumbler of the present invention.
Figure 2A:
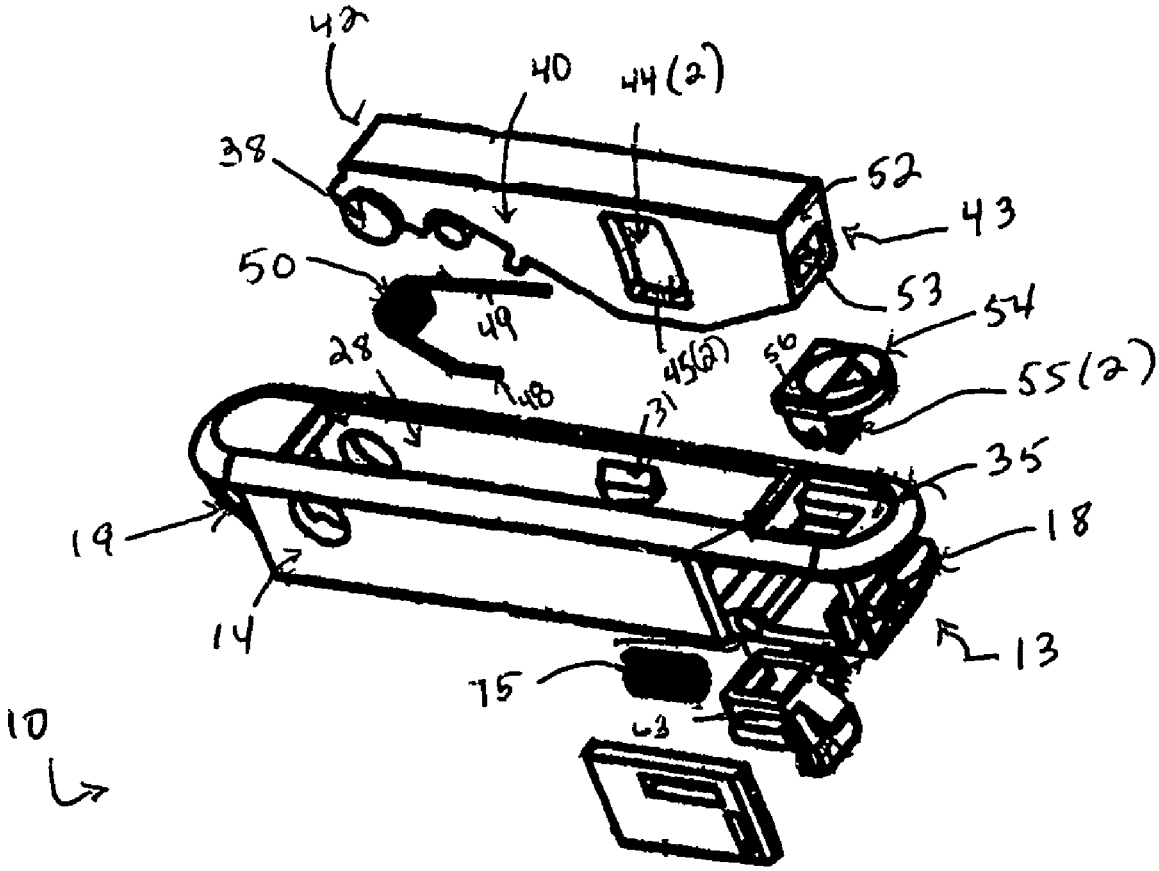
Figure 3:
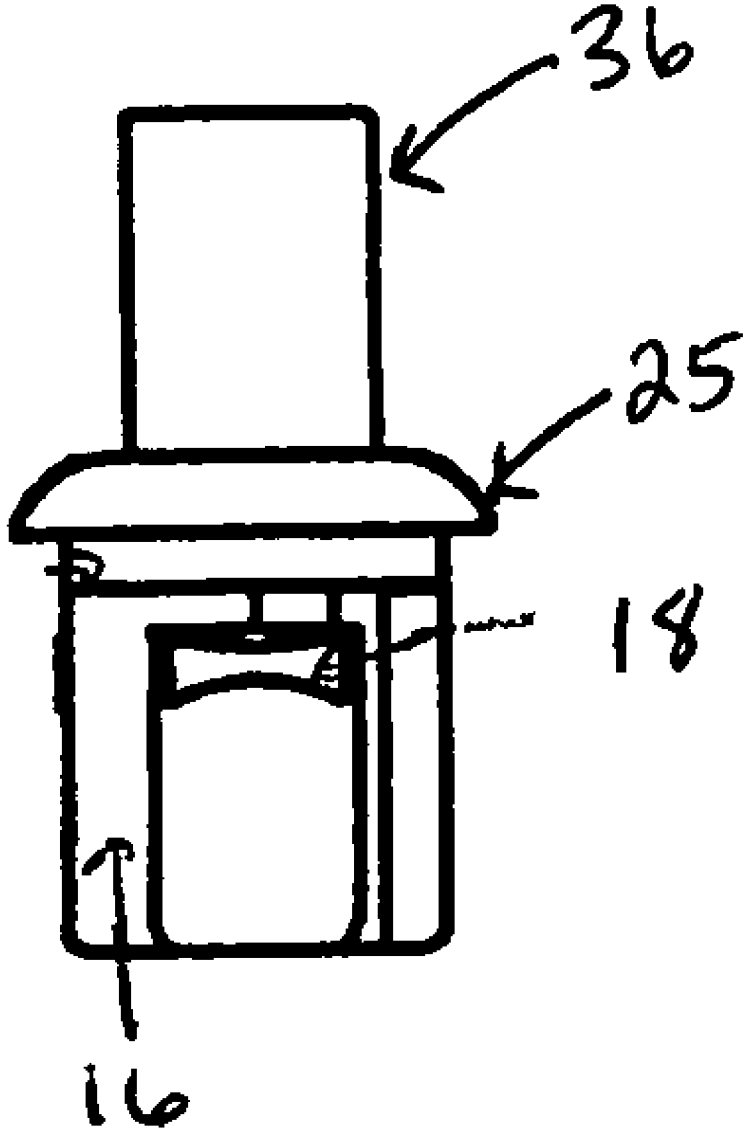
FIG. 3 is a rear end view of the night latch of the present invention with tumbler exposed.
Figure 4:
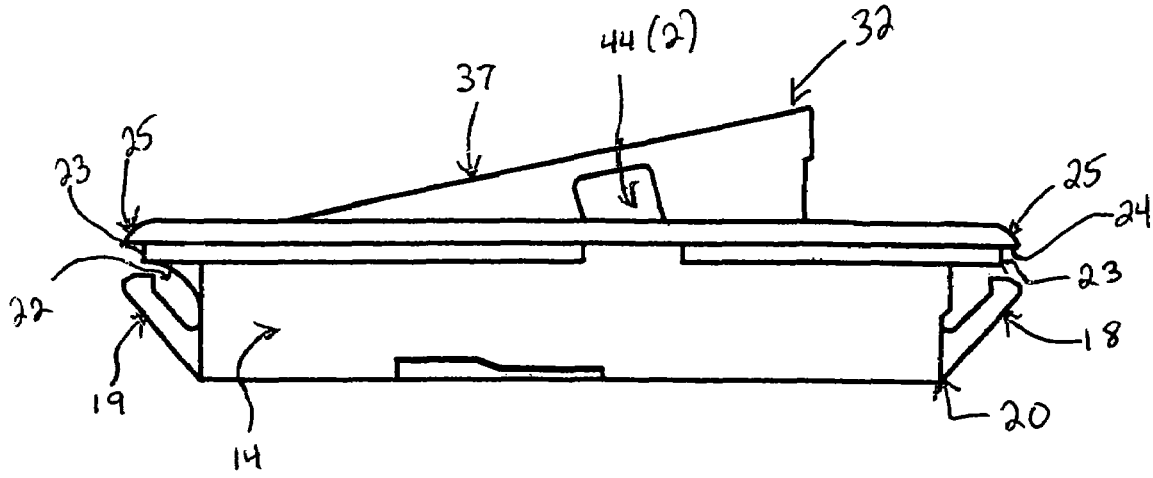
FIG. 4 is a side view of night latch of present invention with tumbler exposed.

In FIG. 1, the night latch of the present invention is shown generally at 10. The night latch 10 is shown positioned over slot 11 in stopping member 12. The slot 11 is shown as having an oval shape, but any other suitable shape and size slots including but not limited to a square, rectangle, oval, etc. can be used depending on the shape of the latch. Preferably, however, the night latch 10 of the present invention will have a portion similarly shaped to the slot 11 as to present a clean appearance when placed in the stopping member 12. In the present embodiment an oval shape, for illustration purposes was used. The stopping member can be a sash, doorframe, or any other member that has another piece sliding over it, where restriction of the sliding member is desired. The tumbler 36 can be in either a raised or lowered position. When raised it prevents movement of the door or sash FIG. 2 is a more detailed view of the contemplated night latch. A housing 13 is generally defined by a first and second sidewall, 14 and 15 respectively, and a front and rear wall, 16 and 17 respectively. It is noted that the terms "front" and "rear" are used only for descriptive purposes and do not read on orientation of the device. Sidewalls 14 and 15 are preferably the same length, as are front and rear walls 16 and 17, respectively, providing for a generally rectangular shape to housing 13. Preferably, when in place within slot 11, sidewalls 14 and 15 contact the edges of slot 11 to provide for a tight fit, and prevent a lateral movement of the night latch 10 within slot 11. In addition, sidewall 14 or 15 can be detachable so as to act like a cover plate for accessing housing 13. In the present embodiment sidewall 14 acts as a detachable cover plate too, as seen in FIG. 2. In another embodiment one may implement a separate cover plate that can be placed near the front end of housing 13, as seen in FIG. 2(*a*).

Front wall 16 can have a front flexible clip 18 and rear wall 17 can have a rear flexible clip 19. Each clip can extend generally in an upward fashion, originating at or near bottom surface 20 of housing 13 and ending just below top plate 25. In the present embodiment each clip creates a notch 22 between a lip 23 on bottom surface 24 of top plate 25. When the night latch 10 is depressed into slot 11 on a stopping member 12, each notch 22 can engage a portion of the stopping member 12. This engagement can prevent vertical (front and back) movement of the night latch 10 within the stopping member 12, as well as preventing the night latch 10 from being easily dislodged from slot 11.

First sidewall 14 has an inner surface 26 and outer surface 27. Second sidewall 15 has inner surface 28 and outer surface 29. The inner surfaces 26 and 28 can have two protrusions 30 and 31 respectively that act as guide members for a tumbler 36. This can be accomplished by setting protrusions 30 and 31 into cavity 32 located inside housing 13. In addition to acting as guide members for tumbler 36 protrusions 30 and 31 acts as a limiting device for tumbler 36, i.e. tumbler 36 will extend out only the distance allowed by the coaction between protrusions 30 and 31 and grooves 44(*a*) and 44(*b*) of tumbler 36. The shape of the protrusions, 30 and 31, can be of any suitable shape including but not limited to a square, rectangle, circle, etc. In the present embodiment protrusions 30 and 31, and their respective grooves, 44(*a*) and 44(*b*) are of rectangular shape. Walls 14 and 15 also can have two circular areas, 33 and 34 respectively, positioned towards rear wall 17. Circular areas 33 and 34 are aligned along the same central axis. These circular areas are designed so as to allow tumbler 36 to rotate from a recessed position to an outwardly position. The circular areas can be any circular areas known in the art, but not limited to an aperture, bore, cavity, etc. In the present embodiment circular areas, 33 and 34 are a bore and an aperture respectively. Bored area 33 on wall 14 can be enlarged so as to allow greater contact with axle 38, this can be achieved by affixing a hollowed out extension of bored area 33 that surrounds a partial portion of outside perimeter of bored area 33, not shown. As mentioned previously one can also have two apertures instead of one aperture and one bored hole, as seen in FIG. 2.

The lip 23 attached to top plate 25 is preferably at least the same size or larger and the same general shape as slot 11. Thus, when night latch 10 is placed into slot 11, lip 23 will contact at least the edges of slot 11, or over spread the upper surface of the stopping member 12. These dimensional attributes will allow for a tight fit that will exhibit a finished smooth exterior, which can be aesthetically pleasing. Although top plate 25 is referred to as a "plate", it is understood that housing 13, clip 18, lip 23 and top plate 25 can be integral pieces, without any need for adhesives or assemblage.

A tumbler 36 is preferably designed to fit within cavity 32 of housing 13. Tumbler 36 may have an upper surface 37, which is preferably smooth and/or flat. A flat surface 37 will exhibit a more finished look for the night latch 10 when it is placed in stopping member 12. Tumbler 36 can have a front end 43 and a rear end 42, along with side surfaces 40 and 41. In addition, tumbler 36 can have a rotation member 38 located on rear end 42 that extends from side surface 40 to side surface 41 on tumbler 36. Rotation member 38 can fit into areas 33 and 34. Rotation member 38 can be any suitable structure known in the art including but not limited to a peg, axle, pin, etc. Furthermore, rotation member 38 can be two separate members affixed to tumbler 36, such as two cylindrical pegs attached to side surfaces 40 and 41 respectively. In the present embodiment rotation member 38 is single axle. In addition rotation member can be part of tumbler 36, or rotation member 38 can stand alone. In the present embodiment rotation member 38 is a part of tumbler 36. By setting rotation member 38 into corresponding areas, 33 and 34, will act so as to allow tumbler 36 pivot within cavity 32, and thus rotate from a recessed position to an extended position and have a portion exposed above the surface of stopping member frame 12.

In addition to having rotation member 38, tumbler 36 also has two arcuate grooves 44(*a*) and 44(*b*) located on side surfaces 40 and 41 respectively. Grooves 44 (*a*) and (*b*) can house guide members 30 and 31, of sidewalls 14 and 15 respectively, and thus provide an arcuate path for tumbler 36 about axis of rotation member 38. Furthermore, grooves 44 (*a*) and (*b*) and guide members 30 and 31 can act as a restricting device for tumbler 36, as mentioned previously. When tumbler 36 is in an activated position guide members 30 and 31 contact the bottoms of 45 (*a*) and (*b*) of grooves 44 (*a*) and (*b*), this interaction will lock guide members 30, 31, and bottoms 45 (*a*) and (*b*), which will cause tumbler 36 to lock into an exposed position, thus exposing the stopping surface 52, which will act as to prevent the sliding member from moving beyond a certain predetermined position.

Figure 5:
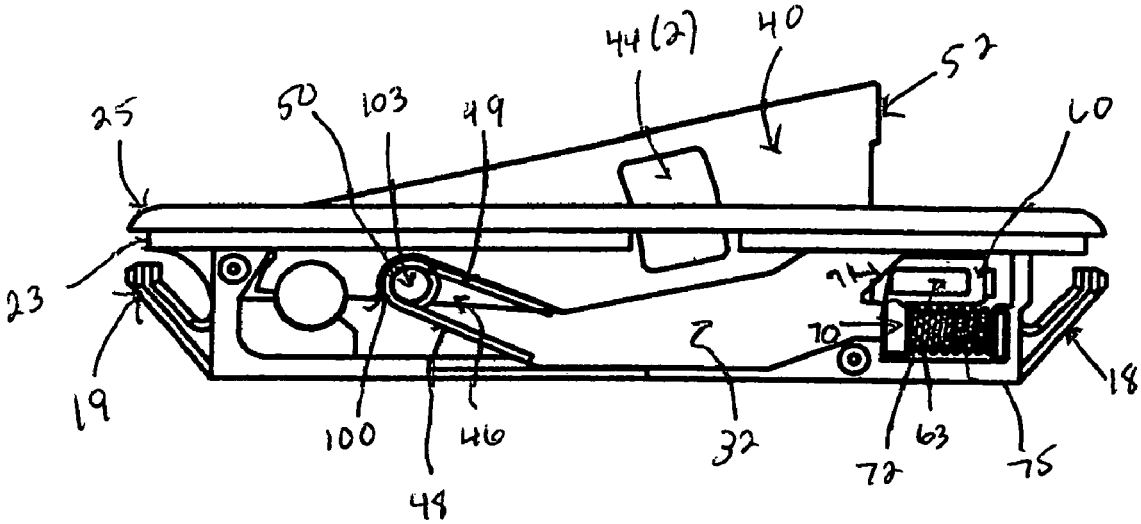
FIG. 5 is a side view of night latch of FIG. 4 with tumbler exposed and side cover plate removed.

Tumbler 36 has a bored area 100, which can be placed on either side of tumbler 36, as seen in FIG. 5. In the present embodiment bored area 100 is located toward the rear end of side surface 40 of tumbler 36. Bored area 100 has a wall 10, not shown, that extends tangentially from plane 102, not shown, to side surface 40. In addition, bored area 100 has a circular shaped protrusion; any circular shaped protrusion known in art can be implemented but not limited to a peg, pin, etc. In the present embodiment a cylindrical peg 103 that extends tangentially the exact distance of wall 101 was implemented.

The force that causes tumbler 36 to rotate in an outwardly fashion, can be created by a spring. Any spring known in the art, but not limited to coil, helical, torsional, etc. can be used. In the present embodiment, a coil spring 46 was implemented. Spring 46 has three members; the first is a coiled portion 50 that rests on cylindrical peg 103. The second member is elongated portion 48, which exerts a constant force on the inside bottom surface 20 of housing 13 and a third member, elongated portion 49, which exerts a constant force on wall 101 in bored area 100 of tumbler 36. The tension created by elongated portions 48 and 49 is of such a nature that the tension will be greater when tumbler 36 is depressed so as to push tumbler 36 in an outwardly fashion when button 54 is triggered.

Front end 43 can have a stopping surface 52. When exposed stopping surface 52 will prevent movement of a sliding frame or member intending to slide over night latch 10. Stopping surface 52 can also have a cavity portion 53, which is a hollowed portion of front end 43 of tumbler 36. Cavity 53 is of such dimensions so as to allow entry of protruding portion of button 54. In addition, cavity 53 should be of such dimensions so that the integrity of tumbler 36 will not be compromised by the frequent contact of a sliding member The release of tumbler 36 from housing 13 can be controlled by an interaction between a button 54 and a spring-loaded release member 55. Button 54 can have a top surface 56 which can be in the same plane as upper surface 37 of tumbler 36. Button 54 can reside in opening 35 of top plate 25. Top surface 56 of button 54 can be designed to have the same shape as opening 35 of top plate 25, however, any suitable shape known in the art, but not limited to square, rectangle, circle, or any combination thereof. In the present embodiment, because of the rectangular look of the night latch 10, opening 35 has a rectangular rear section and circular front tip portion. The top surface 56 of button 54 has the same basic look as opening 35, except that top surface 56 is smaller in proportion, so as to allow movement inside opening 35. Here, the user can access the button 54 easily. Top surface 56 of button 54 can have a groove 57, which the user can engage with a finger, fingernail, pen, pencil, etc. or any other suitable instrument known in the art. Button 54 can be designed to move in different ways, any suitable movement known in the art but not limited to sliding, depression, etc. In the present embodiment button 54 was designed to slide in a up and down manner, within opening 35. When the night latch is not activated, i.e. tumbler 34 is depressed; the top surface 56 of button 54 will rest toward the rear end 58 of opening 35 of to plate 25. When the user wishes to activate night latch 10, the user will apply a downward force to groove 57, which will cause the top button 56 to slide toward the front end 59 of opening 35.

When button 54 is moved toward the front end 59 of opening 35, a release member 55, attached to bottom tooth 55(*a*) of top surface 56 moves in the same direction. Release member 55 can be of any suitable construction known in the art. In the present embodiment release member 55 can best be described as having a rectangular top portion 60, engaged with the bottom tooth 55(*a*) of top surface 56. Rectangular portion 60 can be solid or hollow. In the present embodiment portion 60 is hollow so as to house tooth 55(*a*) of button 54. In addition rectangular portion 60 can have two wings 63 and 64 on both side surfaces 61 and 62 respectively. Wings 63 and 64 can be of any suitable shape known in the art including but not limited to a square, rectangle, oblong, etc. In the present embodiment two oblong wings were implemented. Wings 63 and 64 are allowed to move in a linear back and forth manner, inside slots 68 and 69 respectively, not shown, which are located on sidewalls 14 and 15 respectively. Slots 68 and 69 can be of any suitable shape known in the art including but not limited to square, rectangle, oblong, etc. In the present embodiment two rectangular slots were implemented.

Figure 6:
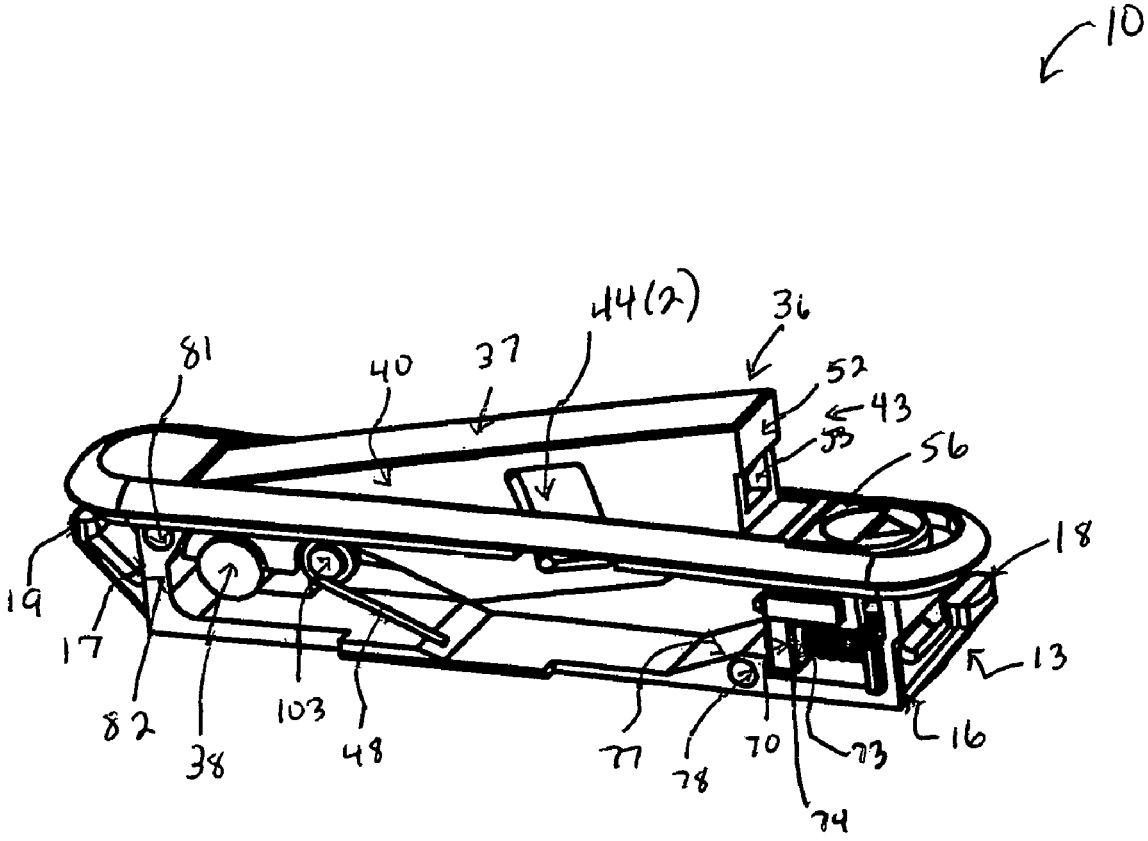
FIG. 6 is a perspective view of night latch of FIG. 5 with cover plate removed.

In addition to having a top rectangular portion 60, release portion 55 has another portion 70 that runs from the back of portion 60 toward the bottom of housing 13, as seen in FIGS. 2 and 6. Portion 70 can best be described as a arm with a tooth like protrusion 71, located in it's upper top surface 72, for engaging tumbler cavity 53, and a circular protrusion 73 located on it's front bottom surface 74, located below rectangular portion 60, facing front of night latch 10, used for housing spring 75, as seen in FIGS. 2 and 5. Any suitable shape known in the art can be used for tooth like protrusion 71 and circular protrusion 73. In the present embodiment a triangular shaped tooth was used for protrusion 71 and a cylindrical shaped peg was used for protrusion 73. Spring 75 can be any suitable spring known in the art but not limited to a coil, leaf, torsional, etc. In the present embodiment a torsional spring was implemented. Spring 75 sits over peg 73, between front surface 74 and back surface 76 of front wall 16. Spring 75 will exert a constant force on front bottom surface 74 of button 54 so as to cause button 54 to want to accelerate toward rear end 58 of opening 35 of top plate 25, thus engaging tooth like protrusion 71 into tumbler's 36 cavity 53. It is this constant force that keeps tumbler 36 in a depressed state.

Figure 7:
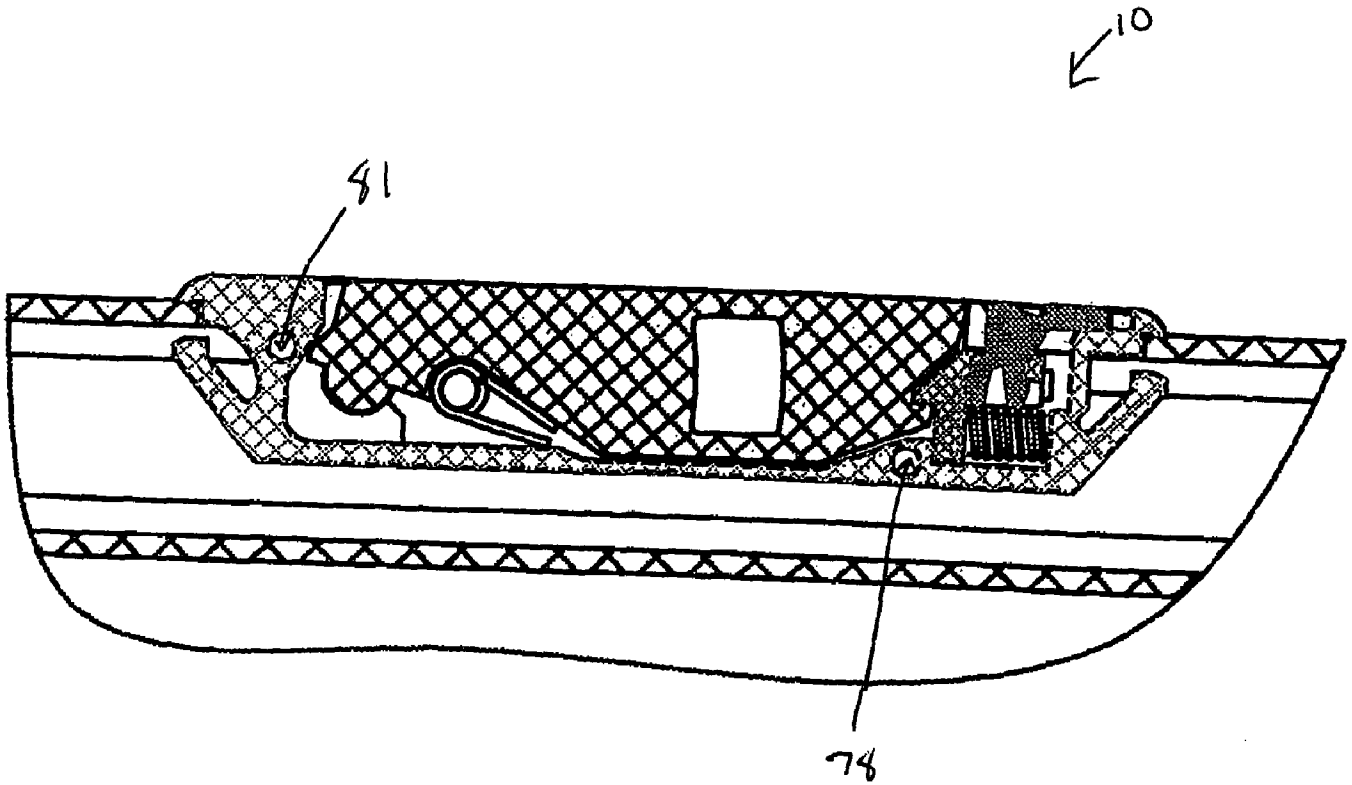
FIG. 7 is a cross-sectional view of night latch of the present invention in place in a stopping member frame with tumbler depressed.
Figure 8:
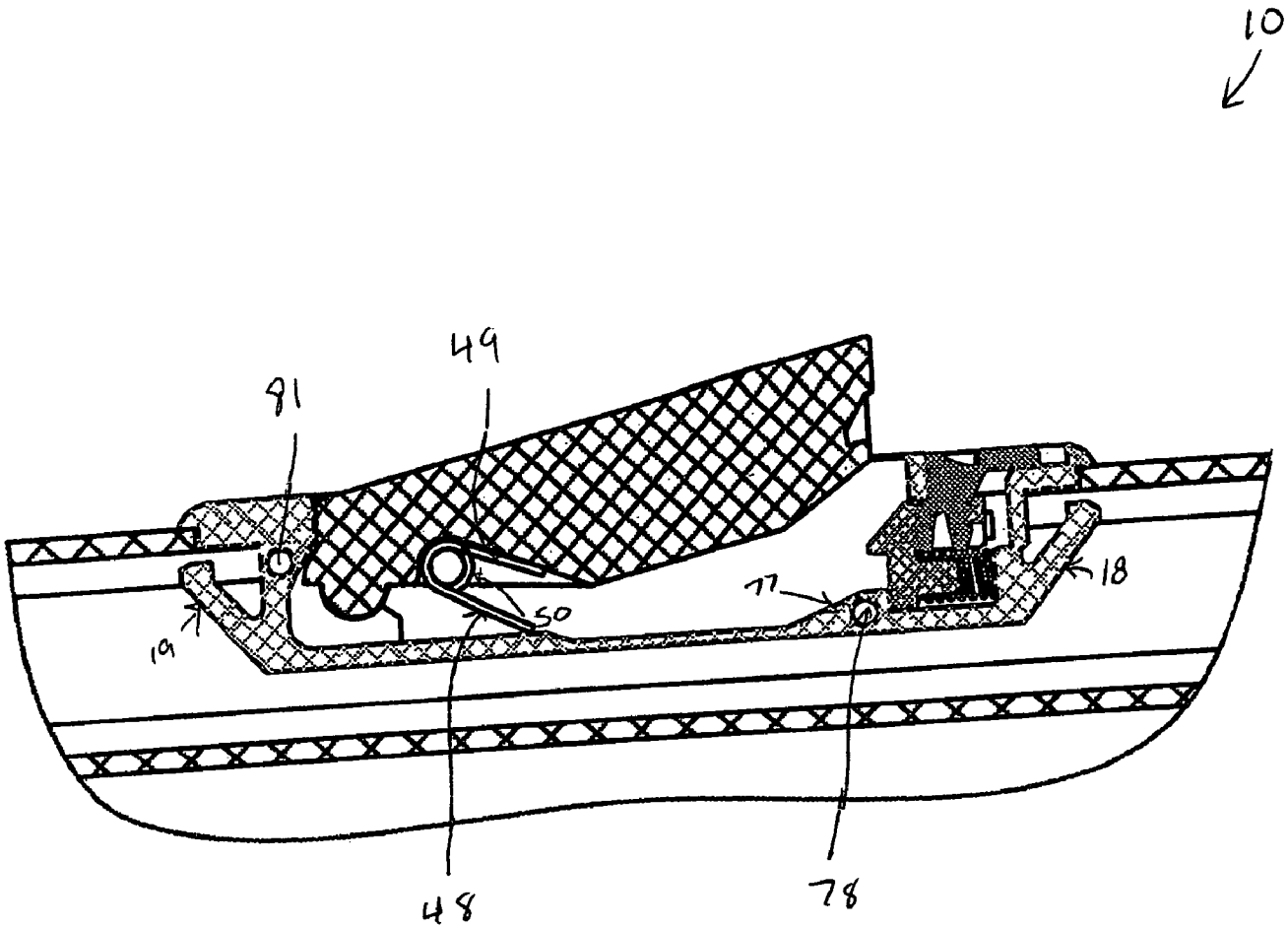
FIG. 8 is a cross-sectional view of night latch of the present invention in place in a stopping member frame with tumbler exposed.

On bottom surface 20 of housing 13 there exists a ramp like protrusion 77 with an aperture 78 at its highest point, as seen in FIGS. 7 and 8. Protrusion 77 can serve two functions. Protrusion 77 can provide added stopping power for button 54 when tumbler 36 is activated, thus preventing the force of spring 75 from rotating button 54 out of opening 35 of top plate 25. Furthermore, aperture 78 of protrusion 77 acts as a housing for one of cover plate 14's pins, 79. Pins 79 and pin 80 are located on the bottom of inside surface 26 and the top rear end of inside surface 26 respectively. When access to the inside of housing 13 is needed, cover plate 14 can be snapped out of place. When access to inside of housing 13 is no longer required cover plate 14 can be snapped back into place by inserting pin 79 into aperture 78 of protrusion 77, and inserting pin 80 into aperture 81, located on the upper side wall 82 of housing 13, thus closing housing 13.

In another embodiment one may have the tumbler with a protrusion and the arm of the release member with a recess. The functionality of the vent stop would not be altered with this type of embodiment.

When the user desires to activate tumbler 36 so as to cease movement of sliding window member, the user will exert a downward force, greater than that of spring 75, on groove 57, of button 54. This force will cause button 54 to move in a direction opposite that of the stored potential energy of spring 75, thus causing release portion 55 of button 54 to disengage cavity 53 of tumbler 36. When tumbler 36 is free to pivot on the axle 38, the upward force of spring 46 will cause tumbler 36 to rotate in an outwardly direction until rectangular guides 30 and 31 meet with bottoms 45(*a*) and 45(*b*) of grooves 44(*a*) and 44(*b*), at which time stopping surface 53 of tumbler 36 will be exposed, thus preventing sliding window member from opening any further.

As various changes could be made in the above constructions without departing from the scope of the invention, it is intended that all matter contained in the above description shall be interpreted as illustrative and not in a limiting sense. In the view above it will be seen that several objects of the invention are achieved and other advantageous results attained.

We claim:

1. A vent stop for preventing and allowing relative movement of a sliding member, said vent stop comprising:

a housing, said housing including a cavity, formed by a top plate, a front wall and a rear wall and a first and second sidewall joining said front and rear wall and extending from said top plate;

a tumbler disposed in said cavity, said tumbler having a first end and a second end;

a pivot means for pivotally securing said first end of said tumbler to said housing for movement between an extended position and a retracted position within said cavity; a spring for biasing said tumbler into said extended position;

a release member that has a first position for causing said tumbler to be in said extended position, and a second position for causing said tumbler to be retained in said retracted position;

said release member comprising a head piece and an arm piece extending from said head piece, said arm piece having a front surface and a rear surface, a protruding member on said front surface, said protruding member being received by a recess in said front face of said tumbler when said tumbler is in said retracted position to hold said tumbler in said retracted position, said rear surface having a pin extending therefrom;

said release member maintained in said recess by a second spring, and wherein said release member is movable in a direction toward said sliding member to cause release of said tumbler from said retracted position.

2. The vent stop according to claim 1 wherein second said spring is retained in position by said pin.

3. The vent stop according to claim 1 wherein said second spring forces said protruding member into said recess in said tumbler when said release member is released by a user and said tumbler is in said retracted position.

4. The vent stop according to claim 3 wherein said release member has one or more wings extending into respective recesses in said sidewalls.

5. The vent stop according to claim 4 wherein said release member has a contact surface generally in the same plane as the top surface of a top plate.

6. The vent stop according to claim 5 wherein said contact surface has a recess for receiving a member for releasing the release member.

7. The vent stop according to claim 1 wherein at least one sidewall is a removable cover plate.

8. A vent stop for preventing and allowing relative movement of a sliding member, said vent stop comprising:

a housing, said housing including a cavity, formed by a top plate, a front wall and a rear wall and a first and second sidewall joining said front and rear wall and extending from said top plate, said top plate having an front end adjacent said front wall;

a tumbler disposed in said cavity, said tumbler having a first end and a second end;

a pivot means for pivotally securing said first end of said tumbler to said housing for movement between an extended position and a retracted position within said cavity;

a spring for biasing said tumbler into said extended position;

a release member that has a first position for causing said tumbler to be in said extended position, and a second position for causing said tumbler to be retained in said retracted position;

said release member comprising a head piece and an arm piece and an arm piece extending from said head piece, said arm piece having a protruding member extending therefrom that is received by a recess in said front face of said tumbler when said tumbler is in said retracted position to hold said tumbler in said retracted position, said release member sliding from said first position adjacent said tumbler to a second position away from said tumbler;

and wherein said release member has a top surface, a bottom surface, a front face, a rear face and opposing side surfaces, said bottom surface having an arm extending from at least a portion of said bottom surface, said arm having a front surface, a rear surface and a pair of opposing side surfaces and wherein said protruding member extends from one of said rear surfaces and wherein there is a pin protruding from said front surface of said arm, and wherein said release member is movable in a direction toward a sliding member to cause release of said tumbler from said retracted position.

9. A vent stop for preventing and allowing relative movement of a sliding member, said vent stop comprising:

a housing, said housing including a cavity, formed by a top plate, a front wall and a rear wall and a first and second sidewall joining said front and rear wall and extending from said top plate;

a tumbler disposed in said cavity, said tumbler having a first end and a second end;

a pivot means for pivotally securing said first end of said tumbler to said housing for movement between an extended position and a retracted position within said cavity; a spring for biasing said tumbler into said extended position;

a release member that has a first position for causing said tumbler to be in said extended position, and a second position for causing said tumbler to be retained in said retracted position;

said release member comprising a head piece and an arm piece extending from said head piece, said arm piece having a front surface and a rear surface, a recess on said front surface, said recess receiving a protruding member extending from said front face of said tumbler when said tumbler is in said retracted position to hold said tumbler in said retracted position, said rear surface having a pin extending therefrom;

said release member maintained in said recess by a second spring and wherein said release member is movable in a direction toward said sliding member to cause release of said tumbler from said retracted position.

10. The vent stop according to claim 9 wherein said second spring is retained in position by said pin.

11. The vent stop according to claim 9 wherein said second spring forces said recess over said protruding member of said tumbler when said release member is released by a user, and said tumbler is in said retracted position.

12. The vent stop according to claim 11 wherein said release member has one or more wings extending into respective recesses in said sidewalls.

13. The vent stop according to claim 12 wherein said release member has a contact surface generally in the same plane as the top surface of a top plate.

14. The vent stop according to claim 13 wherein said contact surface has a recess for receiving a member for releasing the release member.

15. A vent stop for preventing and allowing relative movement of a sliding member, said vent stop comprising:

a housing, said housing including a cavity, formed by a top place, a front wall and a rear wall, and a first and second sidewall joining said front and rear wall and extending from said top plate, said top plate having a front end adjacent said front wall;

a tumbler disposed in said cavity, said tumbler having a first end and a second end;

a pivot means for pivotally securing said first end of said tumbler to said housing for movement between an extended position and a retracted position within said cavity;

a spring for biasing said tumbler into said extended position;

a release member that has a first position for causing said tumbler to be in said extended position, and a second position for causing said tumbler to be retained in said retracted position, said release member sliding from said first position adjacent said tumbler to a second position away from said tumbler;

said release member comprising a head piece and an arm piece extending from said head piece, said arm piece having a recess that receives a protruding member extending from said front face of said tumbler when said tumbler is in said retracted position to hold said tumbler in said retracted position, said release member sliding from said first position adjacent said tumbler to a second position away from said tumbler;

and wherein said release member has a top surface, a bottom surface, a front face, a rear face and opposing side surfaces, said bottom surface having an arm extending from at least a portion of said bottom surface, said arm having a front surface, a rear surface and a pair of opposing side surfaces and wherein said protruding member extends from one of said rear surfaces and wherein there is a pin protruding from said front surface of said arm, and wherein said release member is movable in a direction toward said sliding member to cause release of said tumbler from said retracted position.

16. The vent stop according to claim 15 wherein at least one sidewall is a removable cover plate.

* * * * *